US006659604B2

(12) United States Patent
Merkel et al.

(10) Patent No.: US 6,659,604 B2
(45) **Date of Patent: *Dec. 9, 2003**

(54) INK JET PRINTING METHOD

(75) Inventors: Paul B. Merkel, Victor, NY (US); Gregory E. Missell, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 41 days.

This patent is subject to a terminal disclaimer.

(21) Appl. No.: 10/008,777

(22) Filed: Dec. 4, 2001

(65) Prior Publication Data

US 2003/0103120 A1 Jun. 5, 2003

(51) Int. Cl.[7] ..... B41J 3/407
(52) U.S. Cl. ..... 347/106; 428/195
(58) Field of Search ..... 347/105, 106; 428/195, 327, 403, 495

(56) References Cited

U.S. PATENT DOCUMENTS 4,916,171 A * 4/1990 Brown et al. ..... 523/161
5,027,131 A * 6/1991 Hasegawa et al. ..... 347/105
5,194,317 A * 3/1993 Sato et al. ..... 428/195
5,989,701 A * 11/1999 Goetzen et al. ..... 428/327
6,328,443 B1 * 12/2001 Missell et al. ..... 347/106
6,348,256 B1 * 2/2002 Rabasco et al. ..... 428/195

FOREIGN PATENT DOCUMENTS

| | | |
|---|---|---|
| JP | 08324101 | 12/1996 |
| JP | 09207430 | 8/1997 |
| JP | 2000-239578 | 9/2000 |

* cited by examiner

*Primary Examiner*—Anh T. N. Vo
(74) *Attorney, Agent, or Firm*—Harold E. Cole; Chris P. Konkol

(57) ABSTRACT

An ink jet printing method having the steps of: A) providing an ink jet printer that is responsive to digital data signals; B) loading the printer with an ink jet recording element having a support having thereon an image-receiving layer of porous polymeric particles in a polymeric binder, the polymeric binder being poly(vinyl alcohol) having a degree of hydrolysis of at least about 95% and having a number average molecular weight of at least about 45,000; C) loading the printer with an ink jet ink composition; and D) printing on the ink jet recording element using the inkjet ink composition in response to the digital data signals.

14 Claims, No Drawings

INK JET PRINTING METHOD

CROSS REFERENCE TO RELATED APPLICATION

Reference is made to commonly assigned, co-pending U.S. patent application Ser. No. 09/608,466 by Missell et al., filed on Jun. 30, 2000 entitled "Ink Jet Recording Element".

FIELD OF THE INVENTION

This invention relates to an ink jet printing method using a porous ink jet recording element containing porous polymeric particles.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Inkjet recording elements are known that employ porous or non-porous single layer or multilayer coatings that act as suitable image-receiving layers on one or both sides of a porous or non-porous support. Recording elements that use non-porous coatings typically have good image quality but exhibit poor ink dry time. Recording elements that use porous coatings exhibit superior dry times, but typically have poorer image quality and are prone to cracking.

A problem with known ink jet recording elements that employ porous single layer or multilayer coatings that act as suitable image-receiving layer is dye stability during storage. In particular, dyes printed on to an inkjet receiver element tend to fade due to exposure to ozone which is present in the atmosphere.

Another problem with ink jet recording elements that employ porous single layer or multilayer coatings that act as suitable image-receiving layers is image stability under high humidity storage conditions. In particular, dyes tend to migrate through the image receiving layer during storage since the dye image receiving layer is hydrophilic and tends to absorb water from the atmosphere.

Copending U.S. patent application Ser. No. 09/608,466, filed Jun. 30, 2000, relates to an jet recording element wherein the image-receiving layer contains porous polymeric particles in a polymeric binder. However, there is a problem with this element in that during preparation of the coating solution, agglomeration of the polymeric particles occurs, which when coated, results in an element having low gloss.

JP 09207430, JP 08324101 and JP 2000/239,578 relate to porous image-receiving layers for ink jet recording elements containing inorganic particles and a poly(vinyl alcohol) having various degrees of hydrolysis. However, there is a problem with these elements in that the references do not disclose the degree of hydrolysis for the poly(vinyl alcohol) necessary to provide good gloss and low cracking.

It is an object of this invention to provide an inkjet printing method using an ink jet recording element that has a fast ink dry time. It is another object of this invention to provide an ink jet printing method using an ink jet recording element that has good stability when exposed to ozone and high humidity conditions. It is another object of the invention to provide an inkjet printing method using an ink jet recording element that has high gloss with minimal cracking.

SUMMARY OF THE INVENTION

These and other objects are achieved in accordance with the invention which comprises an ink jet printing method comprising the steps of:

A) providing an inkjet printer that is responsive to digital data signals;

B) loading the printer with an inkjet recording element comprising a support having thereon an image-receiving layer comprising porous polymeric particles in a polymeric binder, the polymeric binder comprising poly(vinyl alcohol) having a degree of hydrolysis of at least about 95% and having a number average molecular weight of at least about 45,000;

C) loading the printer with an ink jet ink composition; and

D) printing on the ink jet recording element using the ink jet ink composition in response to the digital data signals.

By use of the invention, an inkjet recording element is obtained which has a good dry time and good stability when exposed to ozone and high humidity conditions, and has high gloss with minimal cracking.

DETAILED DESCRIPTION OF THE INVENTION

The support used in the inkjet recording element employed in the invention may be opaque, translucent, or transparent. There may be used, for example, plain papers, resin-coated papers, various plastics including a polyester resin such as poly(ethylene terephthalate), poly(ethylene naphthalate) and poly(ester diacetate), a polycarbonate resin, a fluorine resin such as poly(tetra-fluoro ethylene), metal foil, various glass materials, and the like. In a preferred embodiment, the support is paper or a voided plastic material. The thickness of the support employed in the invention can be from about 12 to about 500 μm, preferably from about 75 to about 300 μm.

The porous polymeric particles which are used in the invention are in the form of porous beads, porous irregularly shaped particles, or are aggregates of emulsion particles.

Suitable porous polymeric particles used in the invention comprise, for example, acrylic resins, styrenic resins, or cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl acetal, ethylene-vinyl acetate copolymers, ethylene-vinyl alcohol copolymers, and ethylene-allyl copolymers such as ethylene-allyl alcohol copolymers, ethylene-allyl acetone copolymers, ethylene-allyl benzene copolymers, ethylene-allyl ether copolymers, ethylene acrylic copolymers and polyoxy-methylene; polycondensation polymers, such as, polyesters, including polyethylene terephthalate, polybutylene terephthalate, polyurethanes and polycarbonates.

In a preferred embodiment of the invention, the porous polymeric particles are made from a styrenic or an acrylic monomer. Any suitable ethylenically unsaturated monomer or mixture of monomers may be used in making such styrenic or acrylic polymer. There may be used, for example, styrenic compounds, such as styrene, vinyl toluene, p-chlorostyrene, vinylbenzylchloride or vinyl naphthalene; or acrylic compounds, such as methyl acrylate, ethyl acrylate, n-butyl acrylate, n-octyl acrylate, 2-chloroethyl acrylate, phenyl acrylate, methyl-α-chloroacrylate, methyl methacrylate, ethyl methacrylate, butyl methacrylate, and mixtures thereof. In another preferred embodiment, methyl methacrylate or ethylene glycol dimethacrylate is used.

In a preferred embodiment of the invention, the porous polymeric particles are crosslinked. They may have a degree of crosslinking of about 27 mole % or greater, preferably about 50 mole %, and most preferably about 100 mole %. The degree of crosslinking is determined by the mole % of multifunctional crosslinking monomer which is incorporated into the porous polymeric particles.

Typical crosslinking monomers which may be used in making the porous polymeric particles employed in the invention are aromatic divinyl compounds such as divinylbenzene, divinylnaphthalene or derivatives thereof; diethylene carboxylate esters and amides such as ethylene glycol dimethacrylate, diethylene glycol diacrylate, and other divinyl compounds such as divinyl sulfide or divinyl sulfone compounds. Divinylbenzene and ethylene glycol dimethacrylate are especially preferred.

The porous polymeric particles used in this invention can be prepared, for example, by pulverizing and classification of porous organic compounds, by emulsion, suspension, and dispersion polymerization of organic monomers, by spray drying of a solution containing organic compounds, or by a polymer suspension technique which consists of dissolving an organic material in a water immiscible solvent, dispersing the solution as fine liquid droplets in aqueous solution, and removing the solvent by evaporation or other suitable techniques. The bulk, emulsion, dispersion, and suspension polymerization procedures are well known to those skilled in the polymer art and are taught in such textbooks as G. Odian in "Principles of Polymerization", 2nd Ed. Wiley (1981), and W. P. Sorenson and T. W. Campbell in "Preparation Method of Polymer Chemistry", 2nd Ed, Wiley (1968).

Techniques to synthesize porous polymer particles are taught, for example, in U.S. Pat. Nos. 5,840,293; 5,993,805; 5,403,870; and 5,599,889, and Japanese Kokai Hei 5[1993]-222108, the disclosures of which are hereby incorporated by reference. For example, an inert fluid or porogen may be mixed with the monomers used in making the porous polymer particles. After polymerization is complete, the resulting polymeric particles are, at this point, substantially porous because the polymer has formed around the porogen thereby forming the pore network. This technique is described more fully in U.S. Pat. No. 5,840,293 referred to above. Thus, the porosity of the porous polymeric particles is achieved by mixing a porogen with the monomers used to make the polymeric particles, dispersing the resultant mixture in water, and polymerizing the monomers to form the porous polymeric particles.

A preferred method of preparing the porous polymeric particles used in this invention includes forming a suspension or dispersion of ethylenically unsaturated monomer droplets containing the crosslinking monomer and a porogen in an aqueous medium, polymerizing the monomer to form solid, porous polymeric particles, and optionally removing the porogen by vacuum stripping. The particles thus prepared have a porosity as measured by a specific surface area of about 35 $m^2/g$ or greater, preferably 100 $m^2/g$ or greater. The surface area is usually measured by B.E.T. nitrogen analysis known to those skilled in the art.

The porous polymeric particles may be covered with a layer of colloidal inorganic particles as described in U.S. Pat. Nos. 5,288,598; 5,378,577; 5,563,226 and 5,750,378, the disclosures of which are incorporated herein by reference. The porous polymeric particles may also be covered with a layer of colloidal polymer latex particles as described in U.S. Pat. No. 5,279,934, the disclosure of which is incorporated herein by reference.

The porous polymeric particles used in this invention have a median diameter less than about 10 μm, preferably less than about 1 μm, and most preferably less than about 0.6 μm. Median diameter is defined as the statistical average of the measured particle size distribution on a volume basis. For further details concerning median diameter measurement, see T. Allen, "Particle Size Measurement", 4th Ed., Chapman and Hall, (1990).

As noted above, the polymeric particles used in the invention are porous. By porous is meant particles which either have voids or are permeable to liquids. These particles can have either a smooth or a rough surface.

The image-receiving layer of the ink jet recording element employed in the invention may contain a surfactant. Suitable surfactants include anionic surfactants or cationic surfactants.

As noted above, the poly(vinyl alcohol) employed in the invention has a degree of hydrolysis of at least about 95% and has a number average molecular weight of at least about 45,000. In a preferred embodiment of the invention, the poly(vinyl alcohol) has a degree of hydrolysis of at least about 98%. In another preferred embodiment of the invention, the poly(vinyl alcohol) has a number average molecular weight of from about 70,000 to about 105,000.

Commercial embodiments of such a poly(vinyl alcohol) are Gohsenol® AH-22, Gohsenol® AH-26 and Gohsenol® AH-17 from Nippon Gohsei.

The image-receiving layer may also contain additives such as pH-modifiers like nitric acid, cross-linkers, rheology modifiers, surfactants, UV-absorbers, biocides, lubricants, water-dispersible latexes, mordants, dyes, optical brighteners etc.

The image-receiving layer may be applied to one or both substrate surfaces through conventional pre-metered or post-metered coating methods such as blade, air knife, rod, roll, slot die, curtain, slide, etc. The choice of coating process would be determined from the economics of the operation and in turn, would determine the formulation specifications such as coating solids, coating viscosity, and coating speed.

The image-receiving layer thickness may range from about 5 to about 100 $\mu$m, preferably from about 10 to about 50 $\mu$m. The coating thickness required is determined through the need for the coating to act as a sump for absorption of ink solvent. The image-receiving layer employed in this invention contains from about 0.20 to about 10.0 g/m$^2$ of polymeric binder, preferably from about 0.40 to about 5.0 g/m$^2$, and about 1.5 to about 60 g/m$^2$ of porous polymeric particles, preferably from about 3.0 to about 30 g/m$^2$.

Inkjet inks used to image the recording elements employed in the present invention are well-known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following example further illustrates the invention.

EXAMPLE

The following elements were prepared with the image-receiving layer as described:

Element 1 of the Invention

A 10% by weight solution of water, borax (sodium tetraborate decahydrate) and a sulfonated polyester dispersion AQ29® (Eastman Chemical Co.) with a coating surfactant Olin 10G®, with the borax to polyester binder ratio being 33:67, was rod coated on a corona-discharge treated resin coated paper for a total dry lay-down of 1.5 g/m$^2$, giving a dry lay-down of borax of 0.5 g/m$^2$ and a polyester binder dry lay-down of 1.0 g/m$^2$. The subbing layer coating was dried in a oven at 40° C. for 20 minutes.

A second solution at about 18% by weight comprised of porous polymeric particles, poly(ethylene glycol dimethacrylate), and a poly(vinyl alcohol) binder, AH-26 from Nippon Gohsei, where the ratio of porous polymer particles to PVA was about 80:20, was blade coated over the subbing layer to a dry lay-down of about 40 g/m$^2$ and dried at 40° C. for about 20 minutes to provide an image-receiving layer.

The number average molecular weight of the poly(vinyl alcohol) listed in Table 2 was estimated from the viscosity of a 4% aqueous solution according to a table provided by a commercial manufacturer of poly(vinyl alcohol). The degree of hydrolysis of the poly(vinyl alcohol) was obtained from the manufacturer.

Element 2 of the Invention

This element was prepared the same as Element 1 except that the poly(vinyl alcohol) in the image-receiving layer was AH-22 from Nippon Gohsei.

Element 3 of the Invention

This element was prepared the same as Element 1 except that the poly(vinyl alcohol) in the image-receiving layer was AH-17 from Nippon Gohsei.

Control Element C-1 (Low m.w. PVA and Low Degree of Hydrolysis)

This element was prepared the same as Element 1 except that the poly(vinyl alcohol) in the image-receiving layer was AL-06 from Nippon Gohsei.

Control Element C-2 (Low Degree of Hydrolysis)

This element was prepared the same as Element 1 except that the poly(vinyl alcohol) in the image-receiving layer was GH-23 from Nippon Gohsei.

Control Element C-3 (Low Degree of Hydrolysis)

This element was prepared the same as Element 1 except that the poly(vinyl alcohol) in the image-receiving layer was GH-17 from Nippon Gohsei.

Control Element C-4 (Low Degree of Hydrolysis)

This element was prepared the same as Element 1 except that the poly(vinyl alcohol) in the image-receiving layer was KH-20 from Nippon Gohsei.

Control Element C-5 (Low Degree of Hydrolysis)

This element was prepared the same as Element 1 except that the poly(vinyl alcohol) in the image-receiving layer was KH-17 from Nippon Gohsei.

Testing

Each element was imaged using an Epson 870 ink jet printer and ink jet inks, Cartridge No. T007 (black) and T008 (color), and then rated for cracking to Table 1.

TABLE 1

| Rating | Cracking Observations |
|---|---|
| 1 | No visible cracks under magnification |
| 2 | Slight micro-cracks under 10X magnification |
| 3 | Very slight visible cracks under no magnification |
| 4 | Heavy cracking, some flaking |
| 5 | Heavy cracking, coating flaking off |

Each element was then measured for 60 degree gloss, using a Gardner Gloss meter. The average gloss of cyan, magenta, yellow, red, blue, green, black, and D-min was recorded in Table 2. Average gloss level of greater than about 35 is acceptable.

TABLE 2

| Element | PVA | Degree of Hydrolysis | Approximate Number Average m.w. | Cracking Rating | Gloss |
|---|---|---|---|---|---|
| 1 | AH-26 | 98 | 90,000–100,000 | 2 | 45 |
| 2 | AH-22 | 98 | 80,000–90,000 | 2 | 43 |
| 3 | AH-17 | 98 | 60,000–65,000 | 4 | 38 |
| C-1 | AL-06 | 92 | 25,000–30,000 | 4 | 10 |
| C-2 | GH-23 | 88 | 80,000–90,000 | 2 | 10 |
| C-3 | GH-17 | 88 | 60,000–65,000 | 3 | 12 |
| C-4 | KH-20 | 80 | 70,000–80,000 | 3 | 15 |
| C-5 | KH-17 | 80 | 65,000–70,000 | 4 | 15 |

The above results show that the elements according to the invention having a poly(vinyl alcohol) with the degree of hydrolysis of at least about 95% and a number average molecular weight of at least about 45,000 all provide good gloss as compared to the control elements. In addition, the elements according to invention with a degree of hydrolysis of at least about 95% and an number average molecular weight of at least about 70,000 provide both in good gloss and low cracking as compared to the control elements.

This invention has been described with particular reference to preferred embodiments thereof but it will be understood that modifications can be made within the spirit and scope of the invention.

What is claimed is:

1. An ink jet printing method comprising the steps of:

A) providing an ink jet printer that is responsive to digital data signals;

B) loading said printer with an ink jet recording element comprising a support having thereon an image-receiving layer comprising porous polymeric particles in a polymeric binder, said polymeric binder comprising poly(vinyl alcohol) having a degree of hydrolysis of at least about 95% and having a number average molecular weight of at least about 45,000, wherein said image-receiving layer contains from about 0.20 to about 10.0 g/m$^2$ of said poly(vinyl alcohol) binder and from about 1.5 to about 60 g/m$^2$ of said porous polymeric particles;

C) loading said printer with an ink jet ink composition; and

D) printing on said ink jet recording element using said ink jet ink composition in response to said digital data signals.

2. The method of claim 1 wherein said porous polymeric particles have a median diameter of less than about 10 $\mu$m.

3. The method of claim 1 wherein said porous polymeric particles have a median diameter of less than about 1 $\mu$m.

4. The method of claim 1 wherein said porous polymeric particles are crosslinked and have a degree of crosslinking of about 27 mole % or greater.

5. The method of claim 1 wherein said porous polymeric particles are made from a styrenic or an acrylic monomer.

6. The method of claim 5 wherein said acrylic monomer comprises methyl methacrylate or ethylene glycol dimethacrylate.

7. The method of claim 1 wherein said poly(vinyl alcohol) has a degree of hydrolysis of at least about 98%.

8. The method of claim 1 wherein said support is paper or a voided plastic material.

9. The method of claim 1 wherein the porosity of said porous polymeric particles is achieved by mixing a porogen with the monomers used to make said polymeric particles, dispersing the resultant mixture in water, and polymerizing said monomers to form said porous polymeric particles.

10. The method of claim 1 wherein said porous polymeric particles have a surface area of at least about 35 m$^2$/g.

11. The method of claim 1 wherein said porous polymeric particles have a surface area of at least about 100 m$^2$/g.

12. The method of claim 1 wherein said image-receiving layer contains from about 0.40 to about 5.0 g/m$^2$ of said poly(vinyl alcohol) binder and from about 3.0 to about 30 g/m$^2$ of said porous polymeric particles.

13. The method of claim 1 wherein said poly(vinyl alcohol) has a number average molecular weight from about 70,000 to about 105,000.

14. An ink jet printing method comprising the steps of:

A) providing an ink jet printer that is responsive to digital data signals;

B) loading said printer with an ink jet recording element comprising a support having thereon an image-receiving layer comprising porous polymeric particles in a polymeric binder, said polymeric binder comprising poly(vinyl alcohol) having a degree of hydrolysis of at least about 98% and having a number average molecular weight of from about 70,000 to 105,000, wherein said image-receiving layer contains from about 0.20 to about 10.0 g/m$^2$ of said poly(vinyl alcohol) binder and from about 1.5 to about 60 g/m$^2$ of said porous polymeric particles;

C) loading said printer with an ink jet ink composition; and

D) printing on said ink jet recording element using said ink jet ink composition in response to said digital data signals.

* * * * *